US007248223B2

(12) United States Patent
Habib et al.

(10) Patent No.: US 7,248,223 B2
(45) Date of Patent: Jul. 24, 2007

(54) FRACTAL MONOPOLE ANTENNA

(75) Inventors: Laurent Habib, Moshav Shapira (IL); Benyamin Almog, Beit Arie (IL)

(73) Assignee: Elta Systems Ltd, Ashdod (IL)

( * ) Notice: Subject to any disclaimer, the term of this patent is extended or adjusted under 35 U.S.C. 154(b) by 0 days.

(21) Appl. No.: 11/293,369

(22) Filed: Dec. 5, 2005

(65) Prior Publication Data

US 2007/0126637 A1 Jun. 7, 2007

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS

| | | | | |
|---|---|---|---|---|
| 4,814,777 | A | 3/1989 | Monser | |
| 6,127,977 | A | 10/2000 | Cohen | |
| 6,452,553 | B1 | 9/2002 | Cohen | |
| 6,525,691 | B2 | 2/2003 | Varadan et al. | |
| 7,015,868 | B2 * | 3/2006 | Puente Baliarda et al. | 343/700 MS |
| 7,113,141 | B2 * | 9/2006 | Almog et al. | 343/795 |
| 2004/0100408 | A1 | 5/2004 | Okado | |
| 2005/0068240 | A1 | 3/2005 | Cohen | |
| 2005/0156788 | A1 | 7/2005 | Lin | |
| 2006/0077101 | A1 * | 4/2006 | Puente Baliarda et al. | 343/700 MS |

FOREIGN PATENT DOCUMENTS

| | | | |
|---|---|---|---|
| EP | 1 471 599 | A1 | 10/2004 |
| WO | 02/01668 | A2 | 1/2002 |
| WO | 03/034538 | A1 | 4/2003 |

OTHER PUBLICATIONS

Carles, P.B., et al., "On the Behavior of the Sierpinski Multiband Fractal Antenna", *IEEE Transaction on Anatennas and Propagation*, vol. 46, No. 4, pp. 517-524, (Apr. 1998).

Soler, J., et al., "Novel Combined Mod-P Multiband Antenna Elements Inspired On Fractal Geometries", *27th ESA Antennas Workshop—Innovative Periodic Antennas, Electromagnetic Bandgap, Left-Handed Materials, Fractals and Frquency Selective Surfaces*, pp. 245-251, (Mar. 2004).

Tsachtsiris, G.F. et al., "Analysis of a Modified Sierpinski Gasket Monopole Antenna Printed on Dual Band Wireless Devices" *IEEE Transactions on Antennas and Propagation*, vol. 52, No. 10, pp. 2571-2579, XP-00120994 (Oct. 10, 2004).

(Continued)

*Primary Examiner*—Hoang V. Nguyen
(74) *Attorney, Agent, or Firm*—The Nath Law Group; Jerald L. Meyer; Stanley N. Protigal

(57) ABSTRACT

A monopole fractal antenna and a method of manufacturing thereof are described. The antenna includes a ground plane having a cavity recessed therein, a radiating arm backed by the cavity and coupled to a feeding line arranged at the cavity, and at least one pair of electrical shunts configured for connecting at least two points selected within the fractal portion of the radiating arm to the ground plane. At least a portion of the radiating arm has a fractal geometric shape. The radiating arm is extended from the cavity along an axis disposed in relation to the ground plane.

23 Claims, 9 Drawing Sheets

OTHER PUBLICATIONS

Romeu, J. et al. "Generalized Sierpinski Fractal Multiband Antenna", *IEEE Transaction on Antennas and Propagation*, vol. 49, No. 8, pp. 1237-1239, XP-001093460 (Aug. 8, 2001).

Ammann, M. J. et al., "Small Planar Monopole covers Multiband BRANs", *30th European Microwave Conference Proceedings*, Paris 2000, vol. 2 of 3 Conf. 30, pp. 242-245, XP-001060920 ( Oct. 4, 2000).

Lee, E. et al., "Novel compact wideband or multi-band planar monopole antenna", *Antennas and Propagation Society International Symposium 2000*, Piscataway, NJ, USA, IEEE, vol. 2, pp. 624-627, Jul. 16, 2000).

* cited by examiner

FRACTAL MONOPOLE ANTENNA

FIELD OF THE INVENTION

The present invention relates generally to wideband performance antennas, and in particular, to fractal antennas.

BACKGROUND OF THE INVENTION

There are many applications in which the small size of the antennas is a desirable feature due to cosmetic, security, aerodynamic and other reasons. There is also demand in the art for design of broadband antennas.

Fractal antennas are known in the art as solutions to significantly reduce the antenna size, e.g., from two to four times, without degenerating the performance. Moreover, applying fractal concept to antennas can be used to achieve multiple frequency bands and increase bandwidth of each single band due to the self-similarity of the geometry. Polarization and phasing of fractal antennas also are possible.

The self-similarity of the antenna's geometry can be achieved by shaping in a fractal fashion, either through bending or shaping a surface and/or a volume, or introducing slots and/or holes. Typical fractal antennas are based on fractal shapes such as the Sierpinski gasket, Sierpinski carpet, Minkovski patches, Mandelbrot tree, Koch curve, Koch island, etc (see, for example, U.S. Pat. Nos. 6,127,977 and 6,452,553 to N. Cohen).

Referring to FIGS. 1A to 1D, several examples of typical fractal antennas are illustrated.

In particular, the Triadic Koch curve has been used to construct a monopole and a dipole (see FIGS. 1A and 1B) in order to reduce antenna size. For example, the length of the Koch monopole antenna is reduced by a factor of 1.9, when compared to the arm length of the regular half-wave dipole operating at the same frequency. The radiation pattern of a Koch monopole is slightly different from that of a regular monopole because its fractal dimension is greater than 1.

An example of a fractal tree structure explored as antenna element is shown in FIG. 1C. It was found that the fractal tree usually can achieve multiple wideband performance and reduce antenna size.

FIG. 1D shows an example of a Sierpinski monopole based on the Sierpinski gasket fractal shape. The original Sierpinski gasket is constructed by subtracting a central inverted triangle from a main triangle shape. After the subtraction, three equal triangles remain on the structure, each one being half of the size of the original one. Such subtraction procedure is iterated on the remaining triangles. In this particular case, the gasket has been constructed through five iterations, so five-scaled version of the Sierpinski gasket can be found on the antenna (circled regions in FIG. 1), the smallest one being a single triangle.

The behavior of various monopole antennas based on the Sierpinski gasket fractal shape is described in U.S. Pat. No. 6,525,691 to Varadan et al., in a paper titled "*On the Behavior of the Sierpinski Multiband Fractal Antenna*," by C. Puente-Baliarda, et al., IEEE Transact. Of Antennas Propagation, 1998, V. 46, No. 4, PP. 517–524; and in a paper titled "*Novel Combined Multiband Antenna Elements Inspired on Fractal Geometries*," by J. Soler, et al., 27$^{th}$ ESA Antenna Workshop on Innovative Periodic Antennas: Electromagnetic Bandgap, Left-handed Materials, Fractals and Frequency Selective Surfaces, 9–11 March 2004 Santiago de Compestele, Spain, PP. 245–251. It is illustrated in these publications that the geometrical self-similarity properties of the fractal structure are translated into its electromagnetic behavior. It was shown that the antenna is matched approximately at frequencies $$f_n \approx 0.26\frac{c}{h}\delta^n,$$

where c is the speed of light in vacuum, h is the height of the largest gasket, $\delta \approx 2$, and n a natural number. In particular, the lowest frequency of operation in such antennas is determined by the height of the largest gasket.

SUMMARY OF THE INVENTION

Despite the prior art in the area of fractal antennas, there is still a need in the art for further improvement in order to provide an antenna that might include the broad band performance and reduced aperture. It would be advantageous to have an antenna that is geometrically smaller than another antenna performing the same functions.

The present invention partially eliminates disadvantages of the prior art antenna techniques and provides a novel fractal monopole antenna that includes a ground plane having a cavity recessed therein, and a radiating arm backed by the cavity. At least a portion of the radiating arm has a fractal geometric shape. The antenna further includes at least one pair of electrical shunts connecting at least two points selected within the fractal portion of the radiating arm to the ground plan.

It should be understood that the term "within the fractal portion" utilized throughout the present application implies also the fractal portion's edges. For example, the points selected within the fractal portion of the radiating arm can be selected on opposite edges of the fractal portion relative to the axis.

The radiating arm is coupled to a feeding line arranged at the cavity. The radiating arm extends from the cavity along an axis disposed in relation to said ground plane. Preferably, the axis is substantially perpendicular to the ground plane. The concept of the invention is not bound to a particular shape of the cavity. For example, the cavity's shape can be selected from a cylindrical shape, conical shape and prismatic shape.

The monopole antenna of the present invention is configured and operable to provide decrease of return losses within predetermined frequency bands provided for another antenna having the same structure as said antenna, but without the pair of electrical shunts and the cavity.

According to one embodiment of the invention, the radiating arm is cut from a solid sheet of a conductive material. The electrical shunts can be formed of a wire or other self supporting conductive materials.

According to another embodiment of the invention, the monopole antenna further includes a substrate made of a nonconductive material. In such a case, the fractal monopole antenna can, for example, be produced by using standard printed circuit techniques. A conducting layer overlying the surface of the substrate can be etched to form a radiating fractal shape of the radiating arm. Alternatively, deposition techniques can be employed to form the fractal conductive layer. Accordingly, the two electrical shunts can be formed as strips of a layer of conductive material arranged on the surface of the substrate.

According to an embodiment of the invention, the fractal geometric shape is a triangular Sierpinski gasket. An iteration ratio of self-similarity of said fractal geometric shape is higher than 2. For example, the largest triangular Sierpinski gasket can be in the form of an equilateral triangle. According to another example, the largest triangular Sierpinski gasket can be in the form of an isosceles triangle.

According to an embodiment of the invention, the feeding terminal is coupled to the apex of the largest triangular Sierpinski gasket.

According to an embodiment of the invention, the points selected within the fractal portion of the radiating arm for coupling the radiating arm to the ground plane via the shunts can be selected at vertices at the base of the largest triangular Sierpinski gasket.

The antenna of the present invention may be fed using any conventional manner, and in a manner compatible with the corresponding external electronic unit (source or receiver) for which the antenna is employed. For example, an external unit can be connected to the radiating arms via a coaxial line (probe). According to another example, an external unit can be coupled to the radiating arms magnetically.

The monopole antenna of the present invention has many of the advantages of the prior art techniques, while simultaneously overcoming some of the disadvantages normally associated therewith.

The monopole antenna according to the present invention can have one broad band performance in the frequency range in which conventional antennas represent multiple bands performance.

The monopole antenna of the present invention can be configured to operate in a broad band within the frequency range of about 20 MHz to 80 GHz.

The monopole antenna according to the present invention may be easily and efficiently manufactured, for example, by using printed circuit techniques.

The monopole antenna according to the present invention is of durable and reliable construction.

The monopole antenna according to the present invention may be relatively thin in order to be inset in the mounting platform without creating a deep cavity therein.

The monopole antenna according to the present invention may be readily conformed to complexly shaped surfaces and contours of a mounting platform. In particular, it can be readily conformable to an airframe or other structures.

The monopole antenna according to the present invention may have a low manufacturing cost.

In summary, according to one general aspect of the present invention, there is provided a monopole antenna comprising:

a ground plane having a cavity recessed therein;

a radiating arm backed by the cavity and coupled to a feeding line arranged at the cavity, said radiating arm being extended from the cavity along an axis disposed in relation to said ground plane, at least a portion of the radiating arm having a fractal geometric shape; and at least one pair of electrical shunts configured for connecting at least two points selected within the fractal portion of the radiating arm to the ground plane.

According to another general aspect of the present invention, there is provided a method for fabricating a monopole antenna, comprising:

forming a ground plane having a sheet of electrically conductive material;

forming a cavity in the sheet of electrically conductive material;

forming a radiating arm backed by the cavity and extended therefrom along an axis disposed in relation to said ground plane, at least a portion of the radiating arm having a fractal geometric shape;

coupling said radiating arm to a feeding line arranged at the cavity; and forming at least one pair of electrical shunts configured for connecting at least two points selected within the fractal portion of the radiating arm to the ground plane.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, preferred embodiments will now be described, by way of non-limiting examples only, with reference to the accompanying drawings, in which.

DETAILED DESCRIPTION OF SPECIFIC EMBODIMENTS

Figure 1A:
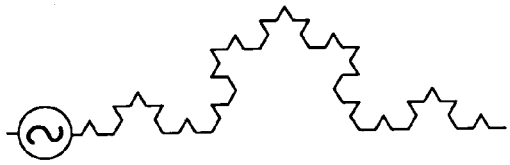
FIG. 1A ( PRIOR ART )
FIGS. 1A to 1D illustrate several typical examples of conventional fractal antennas.
Figure 1B:
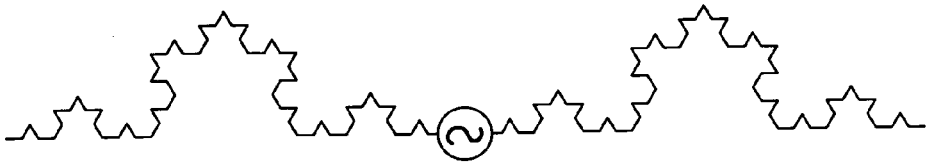
FIG. 1B ( PRIOR ART )
Figure 1C:
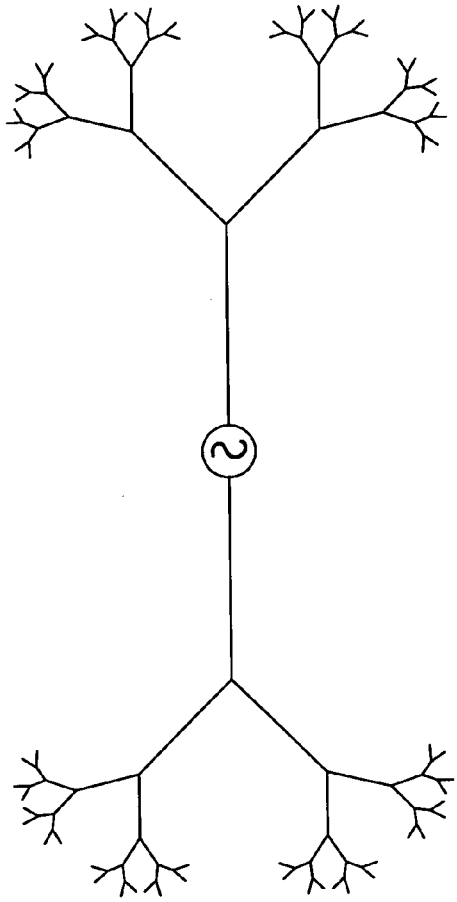
FIG. 1C ( PRIOR ART )
Figure 1D:
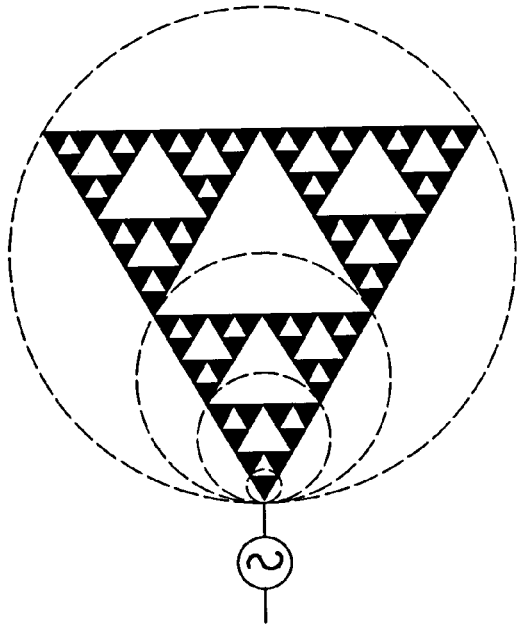
FIG. 1D ( PRIOR ART )

The principles and operation of a monopole antenna according to the present invention may be better understood with reference to the drawings and the accompanying description. It being understood that these drawings are given for illustrative purposes only and are not meant to be limiting. The same reference numerals and alphabetic characters will be utilized for identifying those components which are common in the antenna structure and its components shown in the drawings throughout the present description of the invention.

Figure 2:
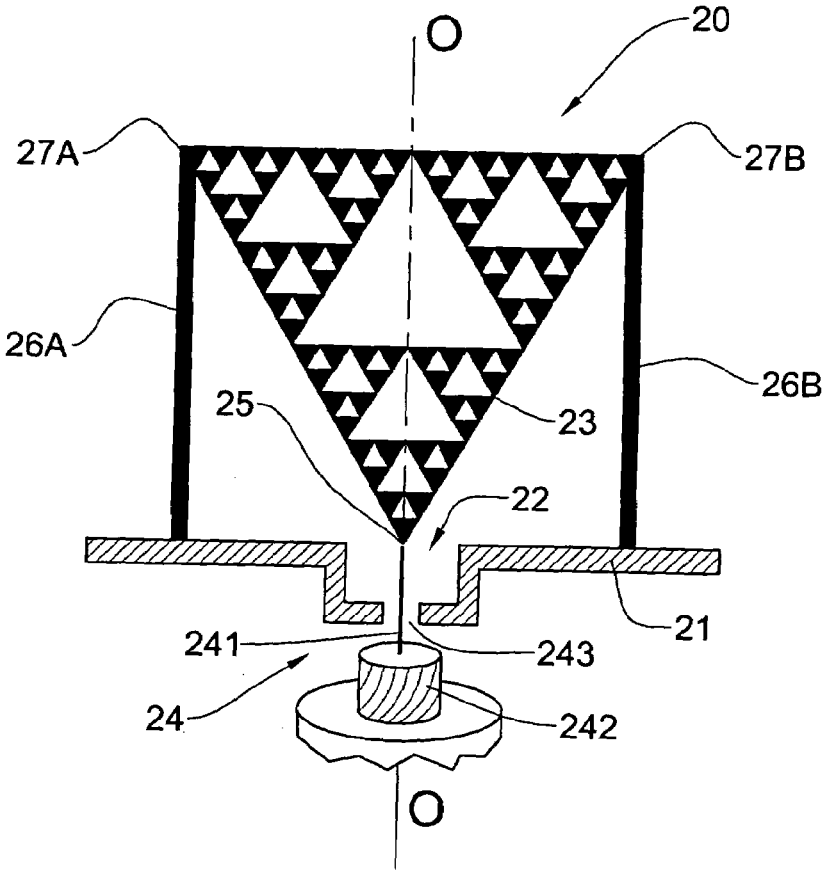
FIG. 2 is a planar view of an exemplary fractal monopole antenna, according to one embodiment of the present invention.

Referring to FIG. 2, a schematic planar view of the fractal monopole antenna 20 according to one embodiment of the present invention is illustrated. It should be noted that this figure as well as further figures (illustrating other examples of the antenna of the present invention) are not to scale, and are not in proportion, for purposes of clarity.

The fractal monopole antenna 20 includes a conductive ground plane 21 having a cavity 22 recessed therein, a radiating arm 23 extended from the cavity along an axis O passing through the center of the cavity 22, and coupled to a feed line 24 arranged at the cavity 22. The feed line 24 is coupled to the radiating arm 23 at a feed point 25 located within the radiating arm 23 for providing radio frequency energy thereto. According to this embodiment of the invention, the cavity 22 has a cylindrical shape. For example, a diameter of the cavity aperture can be in the range of 0.05D to 0.5D, where D is the maximal dimension of the radiating arm 23.

When required, the radiating arm 23 can be mechanically supported by non-conductive supporters (not shown) on the conductive ground plane 21 so that the conductive ground plane 21 is disposed in relation to the axis O. Preferably, but not mandatory, the conductive ground plane 21 is substantially perpendicular to the axis O.

There is a wide choice of materials available which are suitable for the fractal monopole antenna 20. The radiating arm 23 is generally made of a layer of conductive material. Examples of the conductive material suitable for the radiating arm 23 include, but are not limited to, copper, gold and their alloys. The radiating arm 23 is selected to be rather thin, such that the layer thickness t is much less than $\lambda(t<<\lambda)$, where $\lambda$ is the free-space operating wavelength. The conductive ground plane 21 is formed from a sheet of electrically conductive material and can, for example, be made of aluminium to provide a lightweight structure, although other materials, e.g., zinc plated steel, can also be employed.

According to the invention, the radiating arm 23 has a fractal geometric shape. In the general case, at least a portion of the radiating arm must have a fractal geometric shape. According to the embodiment shown in FIG. 2, the fractal geometric shape of the radiating arm 23 is a Sierpinski gasket. An iteration ratio of self-similarity of the fractal geometric shape can be higher than 2.

According to one embodiment of the present invention, the largest triangular Sierpinski gasket is in the form of an equilateral triangle.

According to another embodiment of the present invention, the largest triangular Sierpinski gasket is in the form of an isosceles triangle.

It should be appreciated that when required the radiating arm 23 can be asymmetric. For example, all the sides of the Sierpinski gasket can have different dimensions.

The fractal monopole antenna 20 further includes a first electrical shunt 26A and a second electrical shunt 26B, which are arranged at opposite sides of the largest triangular Sierpinski gasket with respect to axis O. Generally, the first and second electrical shunts 26A and 26B can be configured for connecting any two points selected within the fractal portion of the radiating arm to the ground plane.

According to the embodiment shown in FIG. 2, two points 27A and 27B selected at vertices at the base of the largest triangular Sierpinski gasket are selected for coupling the radiating arm 23 to the ground plane 21 via the electrical shunts 26A and 26B. The first and second electrical shunts 26A and 26B are perpendicular to the ground plane 21. As can be seen, the points 27A and 27B are symmetric with respect to the axis O.

It should be understood that the invention is not bound by this location of the points 27A and 27B. When required, the first electrical shunt 26A can connect any point selected upon a side 28A of the radiating arm 23 to any point selected upon the ground plane 21. Accordingly, the electrical shunt 27B can connect any point selected upon a side 28B of the radiating arm 23 to any other point selected upon the ground plane 21.

The feed point 25 is located at the apex of the largest triangular Sierpinski gasket. It should be apparent to a person versed in the art that when required, the feed point can be within the radiating arm 23 at other locations.

The antenna of the present invention may be fed using any conventional manner, and in a manner compatible with the corresponding external electronic unit (source or receiver) for which the antenna is employed. For example, an external unit (not shown) can be connected to the radiating arms 23 via a coaxial line (probe) having an inner conductor 241 and an outer conductor 242. In particular, the inner conductor 241 can be extended through an opening 243 in the conductive ground plane 21, the cavity 22, and can be electrically connected to the radiating arm 23 at the feed point 25. When required, the outer conductor 242 can be connected to the ground plane 21.

It should be appreciated by a person skilled in the art that an external unit can be coupled to the radiating arms 23 also magnetically, *mutatis mutandis*.

Mechanically, the external unit can be connected to the antenna 20 by providing a connector (not shown) at the end of the feeding line 24, and fastening the coaxial cable or any other transmission line between this connection and the external unit.

It can be understood that a variety of manufacturing techniques can be employed to manufacture the illustrated antenna structure. For example, the ground plane 21 and the radiating arm 23 can be cut from a solid sheet of a conductive material. The first and second electrical shunts 26A and 26B can be formed of a wire or other self supporting conductive materials.

Figure 3:
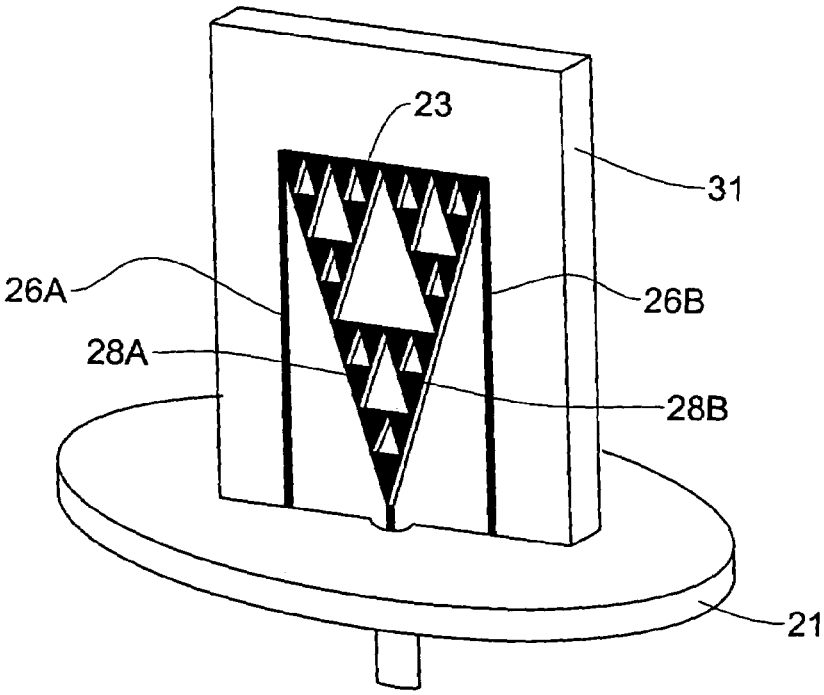
FIG. 3 is schematic perspective view of an exemplary fractal monopole antenna, according to another embodiment of the present invention.

According to another example, the antenna can be built as a conductive layer on a substrate made of a nonconductive material. FIG. 3 shows a schematic perspective view of the antenna 20 built on a substrate 31, according to an embodiment of the present invention. According to this embodiment, the radiating arm 23 and the first and second electrical shunts 26A and 26B are formed as a layer of conductive material overlying a surface of the substrate 31. Examples of the nonconductive material of the substrate 31 include, but are not limited to, Teflon (e.g., Duroid provided by Rogers Cie), Epoxy (e.g., FR4), etc. In some embodiments, the relative dielectric permittivity of the nonconductive material can be in the range of 2 to 100.

The monopole antenna shown in FIG. 3 can be produced by using any standard printed circuit techniques. A conducting layer overlying the surfaces of the substrate can, for example, be etched to form a radiating fractal shape of the radiating arm and the shunts. Alternatively, deposition techniques can be employed to form the fractal conductive layer. In these cases, the first and second electrical shunts 26A and 26B can be formed as strips of a layer of conductive material arranged on the surfaces of the substrate 31.

Figure 4A:
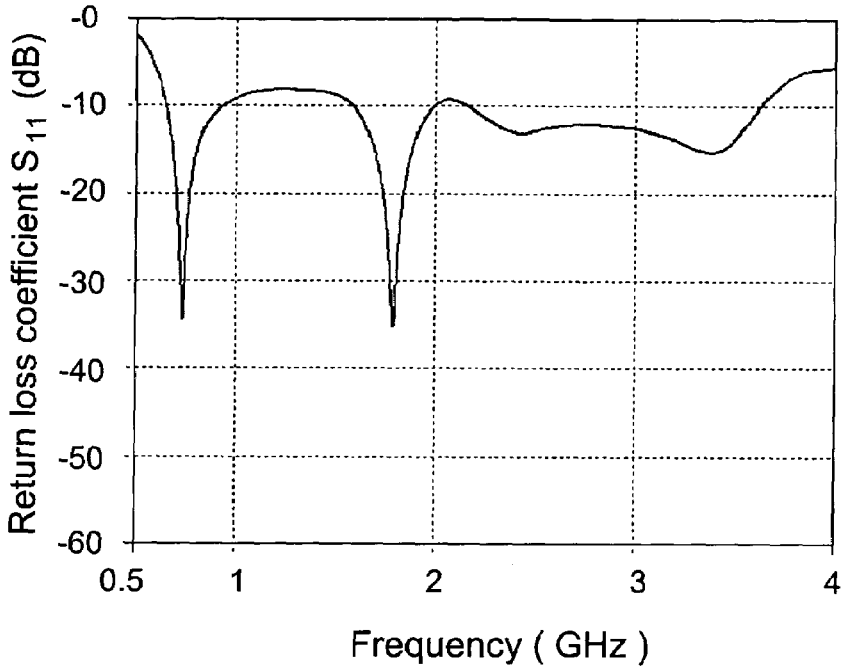
FIGS. 4A and 4B illustrate exemplary graphs depicting the frequency dependence of the input reflection (return loss) coefficient for antenna shown in FIG. 3 and a conventional antenna, respectively.
Figure 4B:
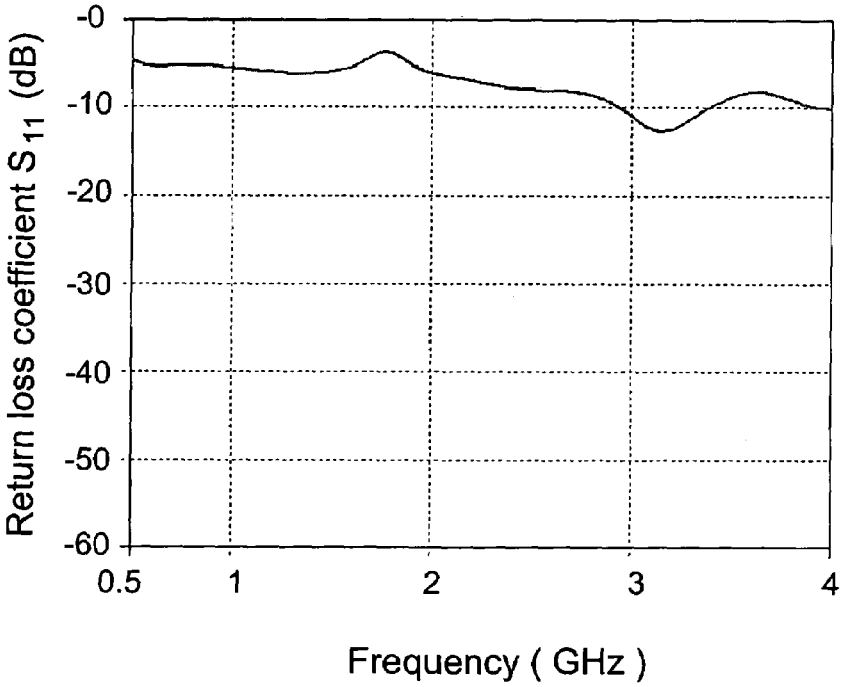

Referring to FIGS. 4A and 4B, exemplary graphs depicting the frequency dependence of the input reflection (return loss) coefficient ($S_{11}$) of the monopole antenna shown in FIG. 3 and the frequency dependence of $S_{11}$ for a similar conventional antenna which does not include the cavity 22, and the electrical shunts 26A and 26B are illustrated, respectively. These graphs were obtained by simulation of the properties of the antennas cut from a solid sheet of conductive material. The largest triangular Sierpinski gasket was selected in the form of an isosceles triangle, in which dimension of the base and sides are 19 cm and 9 cm, respectively. As can be seen, the adding of the cavity and two electrical shunts to a conventional monopole fractal antenna modifies the frequency/return loss characteristic. In particular, the return losses for the antenna of the present invention decrease up to the value better than −9 dB in a relatively broad frequency range of 0.6 GHz–3.5 GHz.

Figure 5A:
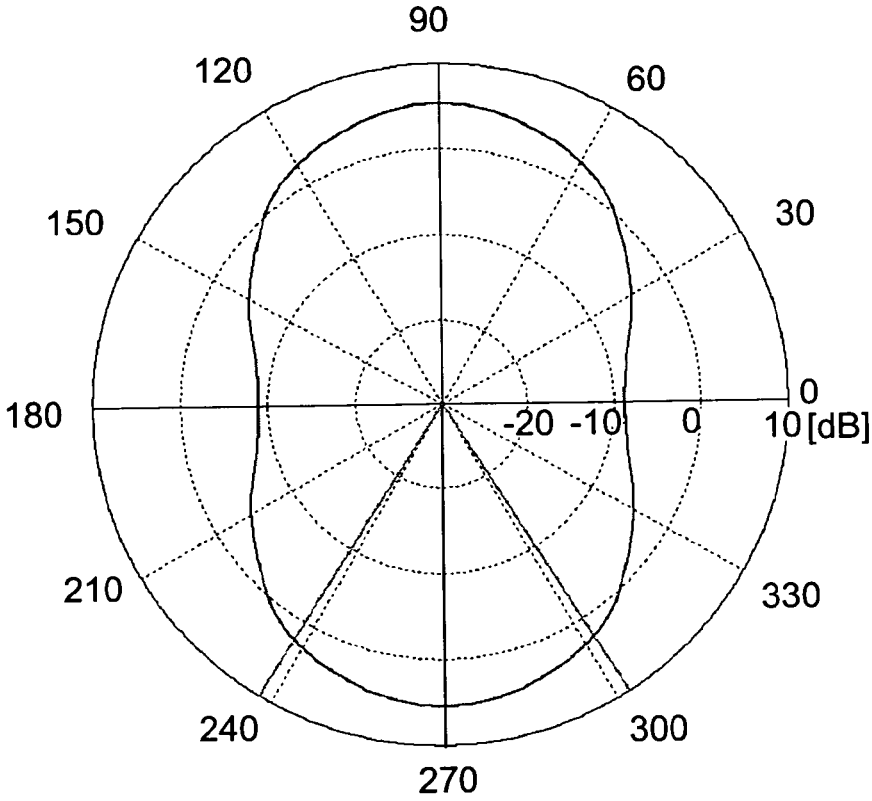
FIGS. 5A and 5B illustrate, respectively, examples of a front to back cut of radiation azimuth pattern in H-plane parallel to the ground plane for the antenna shown in FIG. 3, and the pattern for a similar antenna which does not include the cavity and the electrical shunts.
Figure 5B:
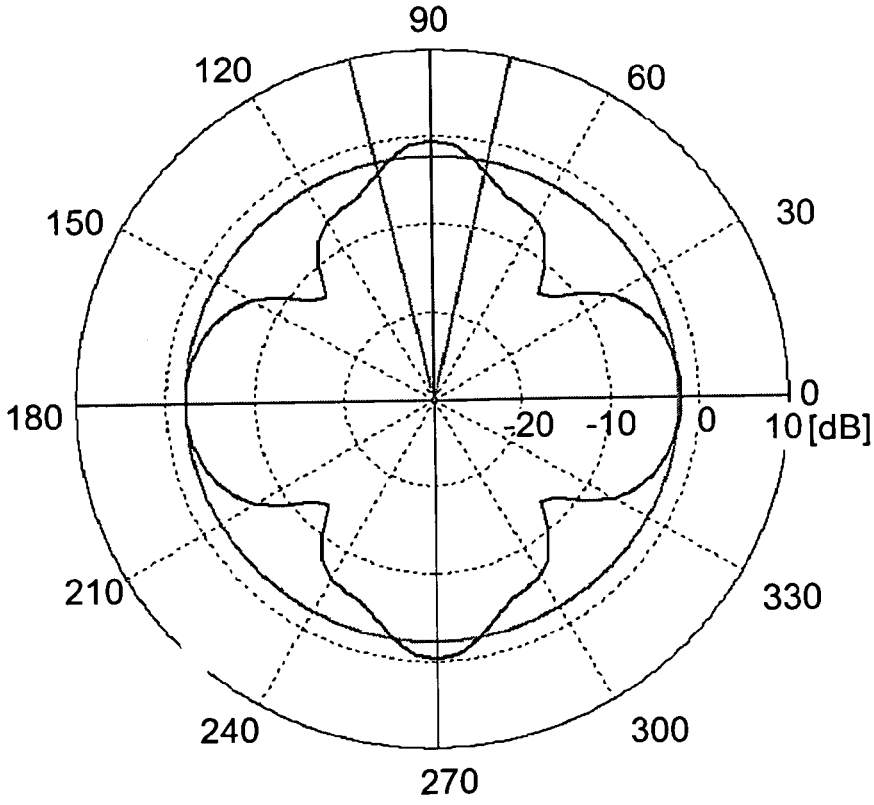

FIGS. 5A and 5B illustrate, respectively, examples of a front to back cut of radiation azimuth pattern in H-plane parallel to the ground plane for the antenna shown in FIG. 3 operating at the frequency of 4 GHz and the pattern for a similar antenna which does not include the cavity and the electrical shunts (conventional monopole fractal antenna). As can be seen, the adding of the cavity and two shunts to the conventional monopole fractal antenna can change significantly the radiation behavior of the antenna in H-plane parallel to the ground. Specifically, the minimal magnitudes of directivity are −10 dBi for the antenna of the invention and −15 dBi for the conventional antenna. Likewise, the maximal magnitudes of directivity are 5 dBi for the antenna of the invention and 0 dBi for the conventional antenna.

Figure 6A:
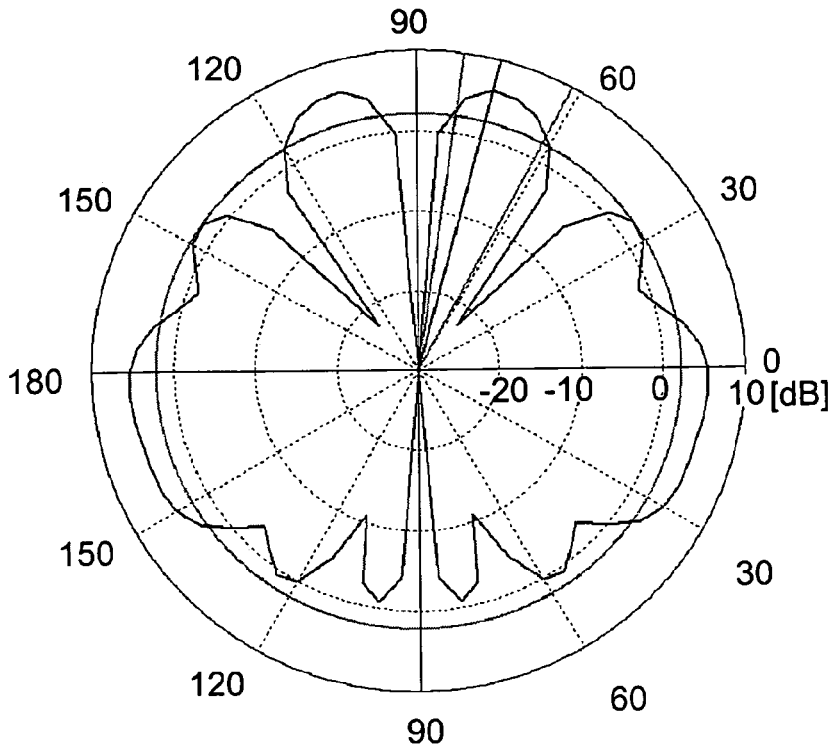
FIGS. 6A and 6B illustrate, respectively, examples of a front to back cut of elevation patterns in E-plane orthogonal to triangular Sierpinski gasket for the antenna shown in FIG. 3, and the pattern for a similar antenna which does not include the cavity and the electrical shunts.
Figure 6B:
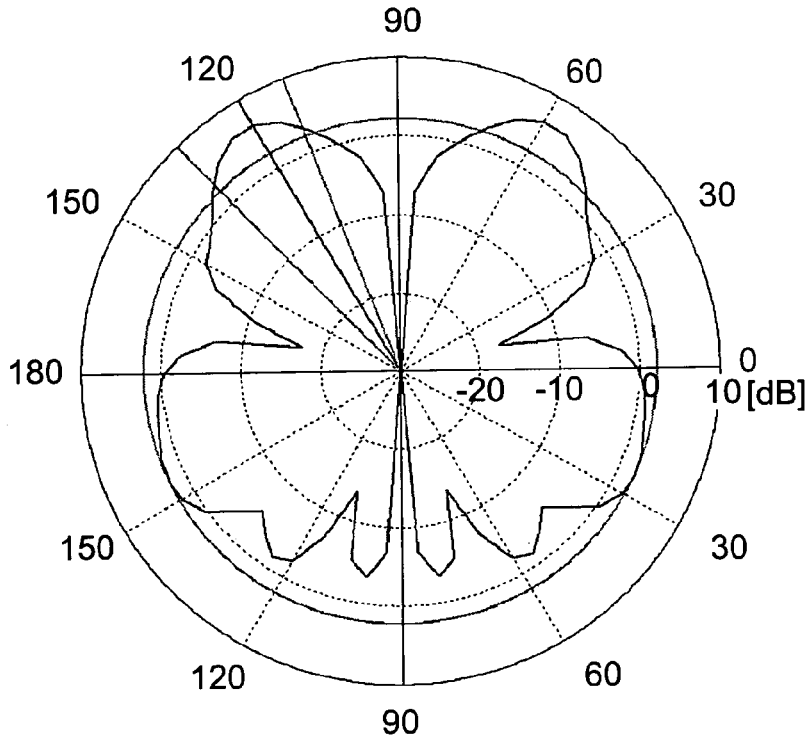

FIGS. 6A and 6B illustrate, respectively, examples of a front to back cut of elevation patterns in E-plane orthogonal to triangular Sierpinski gasket for the antenna shown in FIG. 3 operating at the frequency of 4 GHz and the pattern for a similar antenna which does not include the cavity and the electrical shunts (conventional monopole fractal antenna). As can be seen, the adding of the cavity and two shunts to the conventional monopole fractal antenna can also change significantly the radiation behavior of the antenna in the E-plane. In particular, the gain magnitudes of the antennas in the horizontal direction ($\Theta$ equals 0° or 180°) are greater than 5 dBi and less than 0 dBi for the antenna of the present invention and for the similar conventional antenna, respectively.

It is apparent that the antenna of the present invention is not bound to the example of the cylindrical cavity aperture shown in FIG. 2. In principle, the cavity may have a different configuration than cylindrical. It could be generally conical, tapered, prismatic or otherwise symmetrical with regard to the axis O passing through the center of the cavity.

Figure 7:
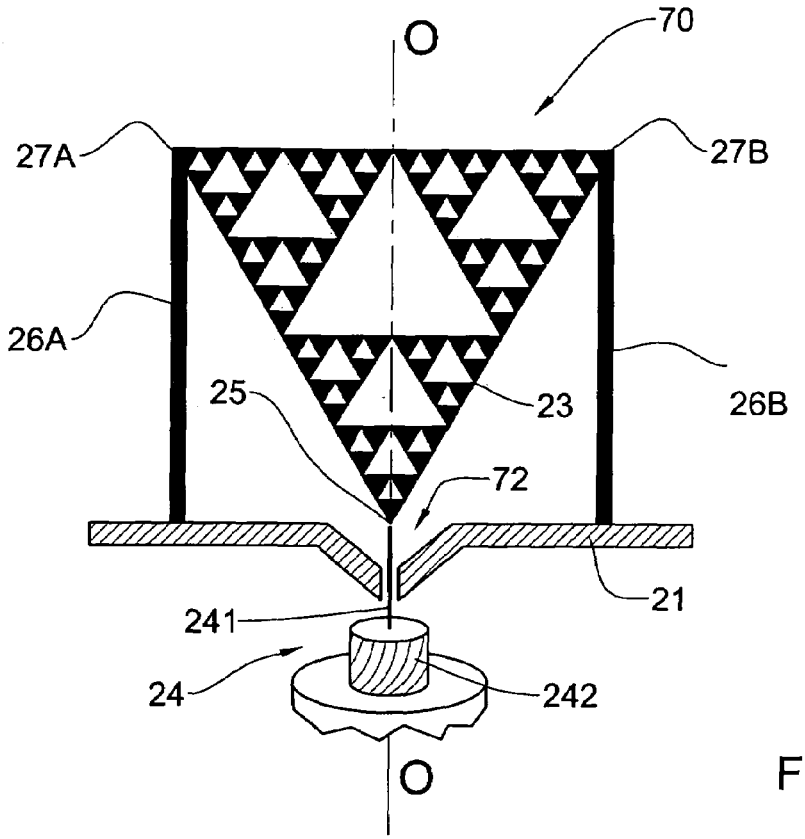
FIG. 7 illustrates an alternative embodiment of the antenna of the present invention.
Figure 8:
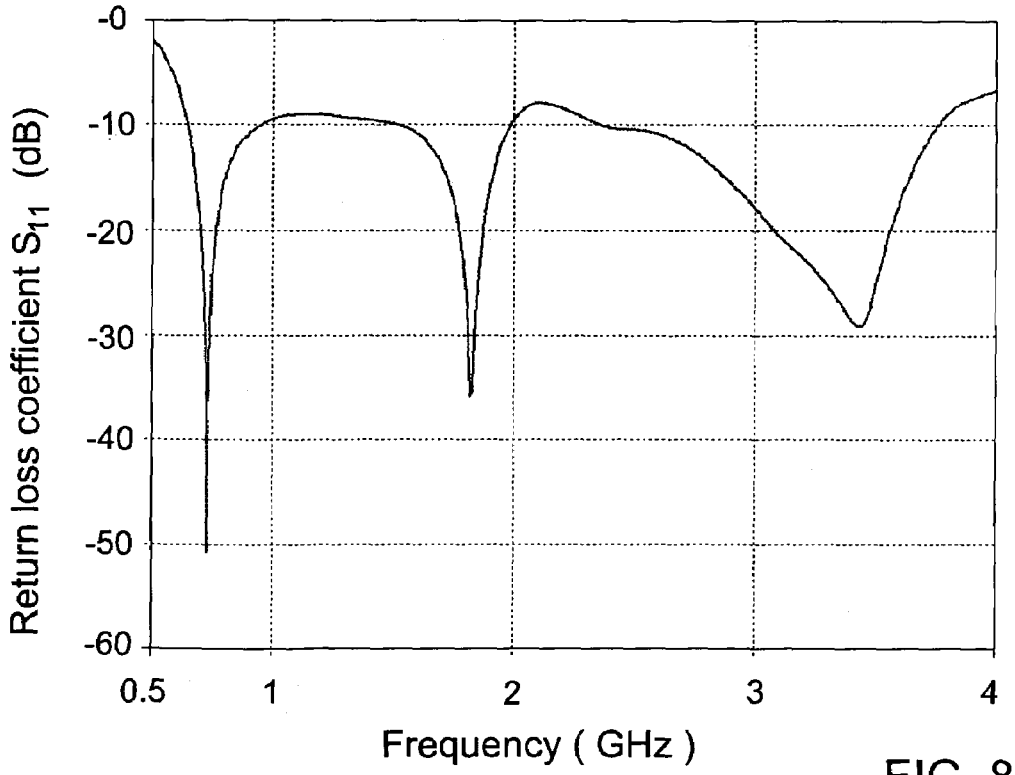
FIG. 8 illustrates an exemplary graph depicting the frequency dependence of the input reflection (return loss) coefficient ($S_{11}$) of the monopole antenna shown in FIG. 7.

Referring to FIG. 7, an alternative embodiment of an antenna 70 of the present invention is illustrated. The antenna 70 is identical to antenna 20 in all respects except that a cavity 72 has a conical shape. FIG. 8 illustrates an exemplary graph depicting the frequency dependence of the input reflection (return loss) coefficient ($S_{11}$) of the monopole antenna shown in FIG. 7. It can be seen that the cavity's shape does not change significantly the return loss characteristics of the antenna of the present invention.

Figure 9:
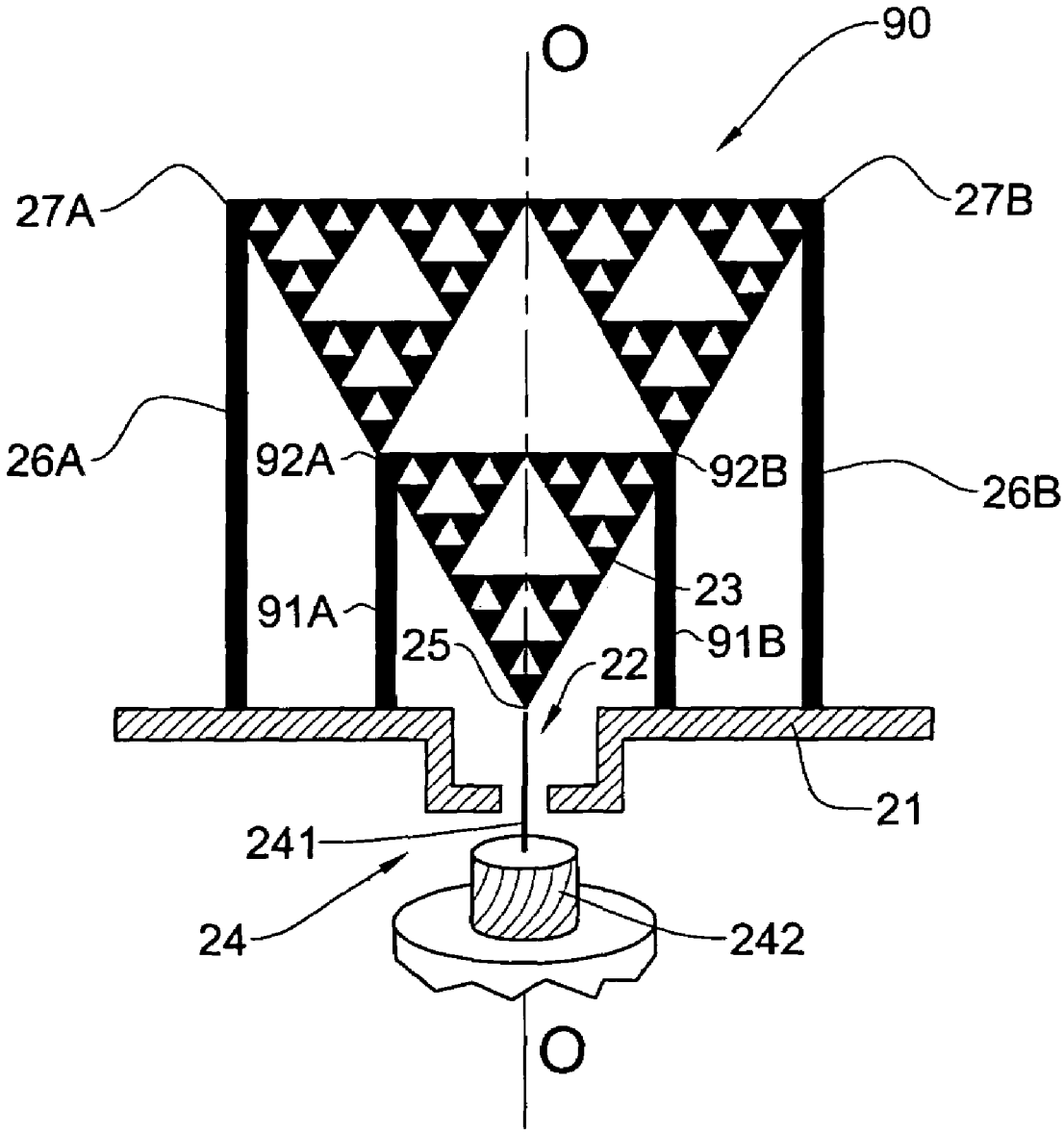
FIG. 9 illustrates an exemplary fractal monopole antenna, according to still another embodiment of the present invention.

It should also be noted that when required more than one pair of electrical shunts can be used for coupling the radiating arm 23 to the ground plate 21. For example, two or more electrical shunts can be arranged at each side of the arms with respect to the axis O to connect four or more (even number) of points selected within the radiating arm 23 to the corresponding number of points selected within the ground plane 21. FIG. 9 shows an example of a fractal monopole antenna 90 in which the radiating arm 23 is connected to the ground plane 21 by two pairs of electrical shunts. In this case, a first pair of shunts 26A and 26B connects the vertices at the base (points 27A and 27B) of the largest triangular Sierpinski gaskets to the ground plane 21, i.e., similar to the connection shown in FIG. 2. Moreover, a second pair of shunts 91A and 91B connects points 92A and 92B selected upon the middle of sides of the largest triangular Sierpinski gasket to the ground plane 21.

It is apparent that the antenna of the present invention is not bound to the examples of the antennas having a planar radiating arm. If necessary, the radiating arm can have a volume (three-dimensional) fractal geometric shape.

Figure 10:
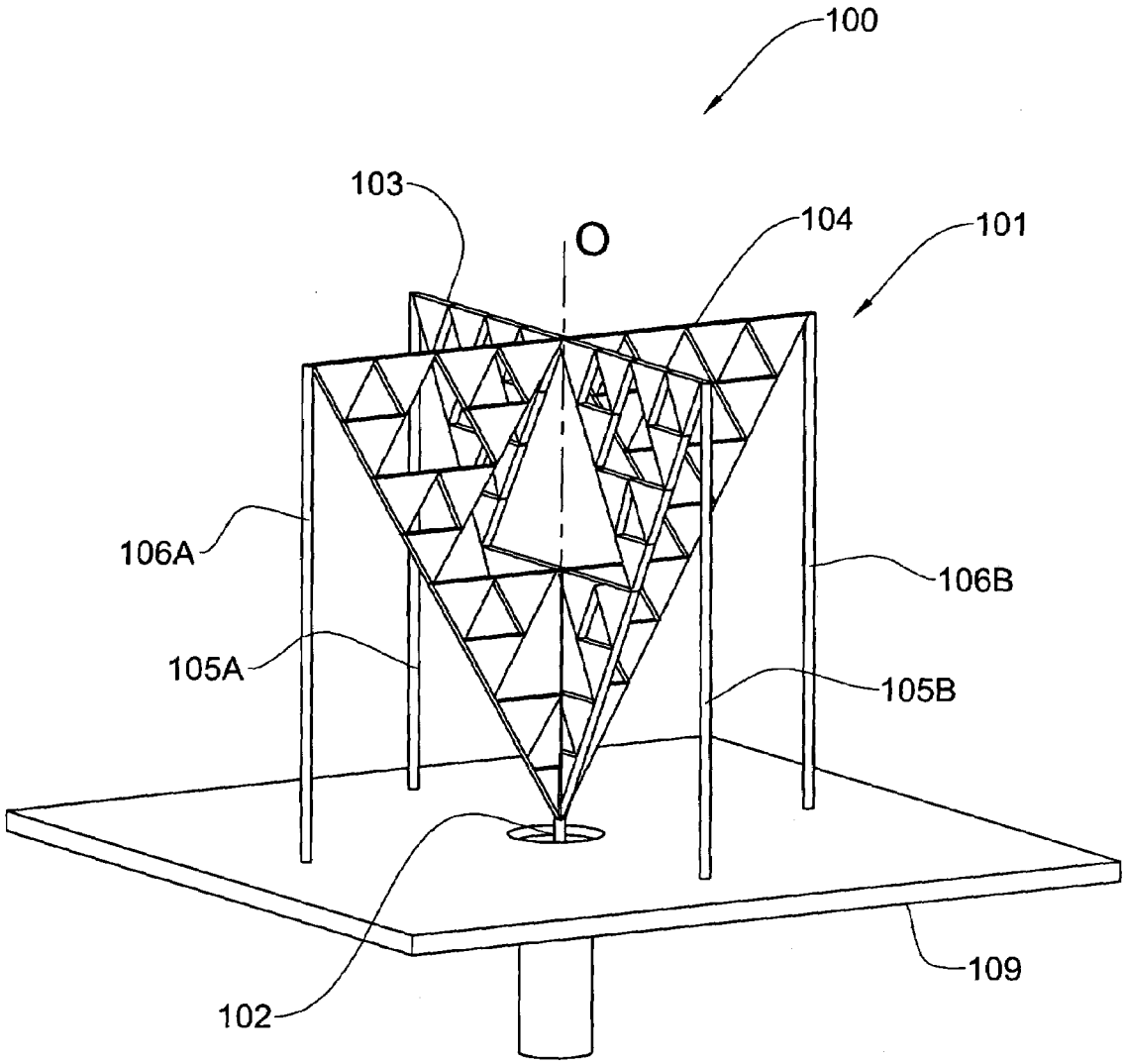
FIG. 10 illustrates a perspective view of an exemplary fractal monopole antenna, according to yet another embodiment of the present invention.

Referring to FIG. 10, yet a further embodiment of a fractal monopole antenna 100 of the present invention is illustrated. The antenna 100 differs from the antenna (20 in FIG. 2) in the fact that a radiating arm 101, extended from a cavity 102, includes two Sierpinski gaskets 103 and 104 intersecting along the axis O. Preferably, but not mandatory, the Sierpinski gaskets 103 and 104 intersect each other at the right angles. The fractal monopole antenna 100 includes a first pair of electrical shunts 105*a* and 105*b* and a second pair of electrical shunts 106*a* and 106*b* connecting the opposite sides of the Sierpinski gaskets 103 and 104, respectively to the ground plane 109. It should be understood that the invention is not bound to any particular point on sides of the Sierpinski gaskets selected for connecting the electrical shunts 85*a*, 85*b*, 106*a* and 106*b* to the ground plane 109. Likewise, two or more pairs of electrical shunts can be employed with the each of the Sierpinski gaskets 103 and 104.

Figure 11:
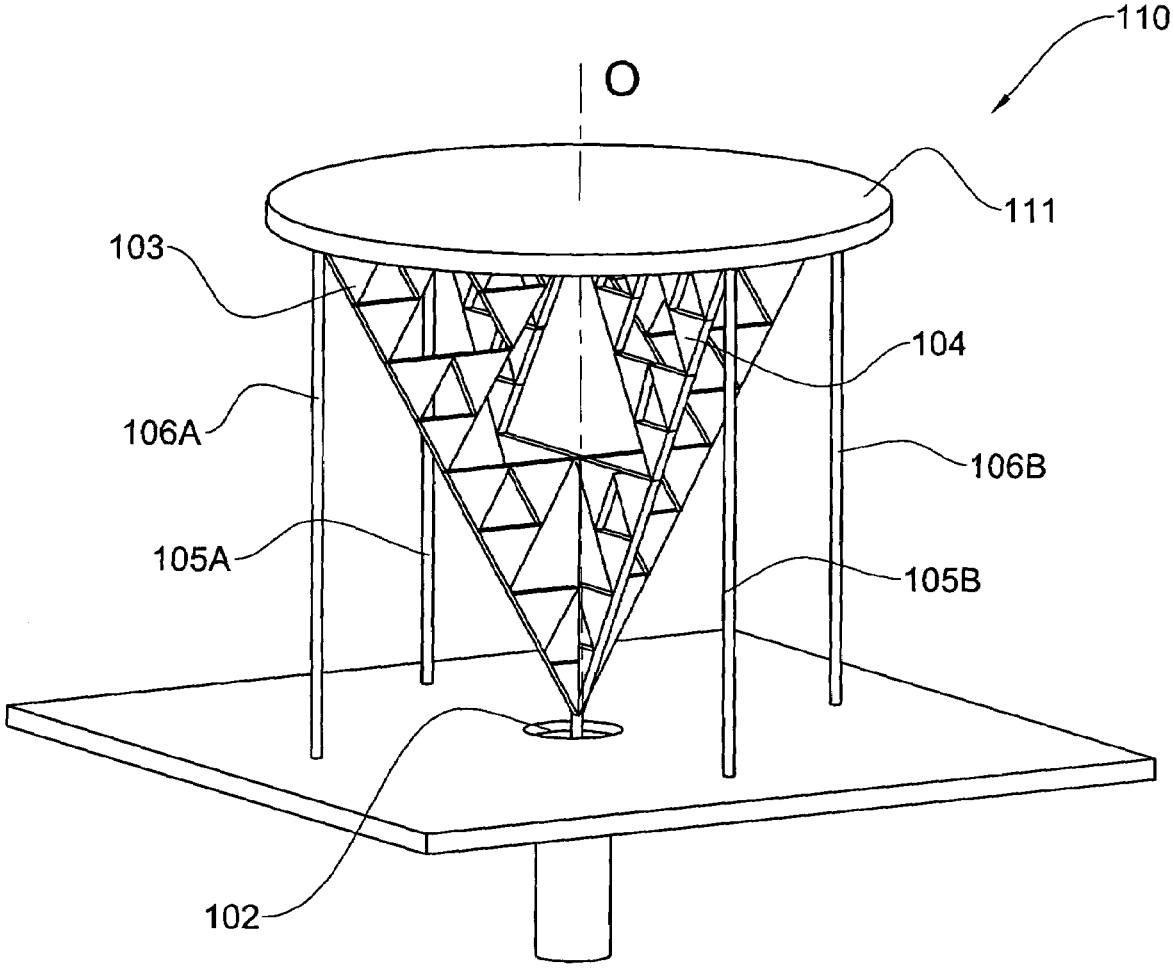
FIG. 11 illustrates a perspective view of an exemplary fractal monopole antenna, according to still a further embodiment of the present invention.

Referring to FIG. 11, yet an embodiment of a fractal monopole antenna 110 of the present invention is illustrated. The antenna 110 differs from the antenna (100 in FIG. 10) in the fact that it further includes a second ground plane 111 adjacent to the bases of the largest triangular Sierpinski gaskets 103 and 104. According to this embodiment of the invention, the second ground plane 111 has a circular (disk) shape. However it should be understood that when desired the shape can be square, rectangular, oval, polygonal, etc.

It can be appreciated by a person of the art that the monopole antenna of the present invention may have numerous applications. The list of applications includes, but is not limited to, various devices operating a narrow and/or broad bands within the frequency range of about 20 MHz to 80 GHz. The size of the antenna of the present invention can be of the order of millimeters to tens of centimeters and the thickness of the order of millimeters to few centimeters.

For example, the antenna of the present invention would be operative with communication devices (e.g., mobile phones, PDAs, remote control units, telecommunication with satellites, etc.), radars, telemetry stations, jamming stations, etc.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is apparent that the antenna of the present invention is not bound to the examples of the symmetric antennas.

It should be noted that generally, the fractal geometric shape of the radiating arms is not bound by the Sierpinski gasket shape. Examples of the fractal geometric shapes suitable for the purpose of the present invention include, but are not limited to, Sierpinski carpet, Minkovski patches, Koch island, etc. When required, a combination of different self-similar patterns can be utilized.

It should be noted that when desired each of the following components: the electrical shunts 26A, 26B, 106A, 106B, the ground plane 21, and the second ground plane 111 can have a fractal geometric shape.

It should be noted that the single element antenna described above with references to FIGS. 2, 3, 7 and 9–11, can be implemented in an array structure of a regular or fractal form, taking the characteristics of the corresponding array factor. Furthermore, when required, this array antenna can be monolithically co-integrated on-a-chip together with other elements (e.g. DSP-driven switches) and can also radiate steerable multibeams, thus making the whole array a smart antenna.

In order to limit the radiation to one direction, an additional ground plane parallel to the plane of the radiating arm may be provided for the antenna of the present invention. For example, the additional ground plane may be arranged the other side of the substrate than on which the antenna is printed. Such implementation of the antenna can increase the radiation directivity of the antenna.

Additionally, the antenna of the present invention may allow reducing the development effort required for connectivity between different communication devices associated with different communication services and operating in various frequency bands.

The antenna of the present invention may be utilized in various intersystems, e.g., in communication within the computer wireless LAN (Local Area Network), PCN (Personal Communication Network) and ISM (Industrial, Scientific, Medical Network) systems.

The antenna may also be utilized in communications between the LAN and cellular phone network, GPS (Global Positioning System) or GSM (Global System for Mobile communication).

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims.

The invention claimed is:

1. A monopole antenna comprising:

a ground plane having a cavity recessed therein;

a radiating arm backed by the cavity and coupled to a feeding line arranged at the cavity, said radiating arm being extended from the cavity along an axis disposed in relation to said ground plane, at least a portion of the radiating arm having a fractal geometric shape; and at least one pair of electrical shunts configured for connecting at least two points selected within the fractal portion of the radiating arm to the ground plane.

2. The monopole antenna of claim 1 wherein the provision of said at least one pair of electrical shunts and said cavity provides for reducing return losses within predetermined frequency bands as compared to another antenna having the same structure as said monopole antenna, but without said at least one pair of electrical shunts and said cavity.

3. The monopole antenna of claim 1 wherein said at least two points are selected on opposite edges of the fractal portion of the radiating arm relative to said axis.

4. The monopole antenna of claim 1 wherein said radiating arm is cut from a solid sheet of a conductive material.

5. The monopole antenna of claim 1 further comprising a substrate made of a nonconductive material, wherein said radiating arm and said at least one pair of electrical shunts are formed as a layer of conductive material overlying a surface of said substrate.

6. The monopole antenna of claim 1 wherein said fractal geometric shape includes at least one triangular Sierpinski gasket.

7. The monopole antenna of claim 6 wherein the largest triangular Sierpinski gasket is in the form of an equilateral triangle.

8. The monopole antenna of claim 6 wherein the largest triangular Sierpinski gasket is in the form of an isosceles triangle.

9. The monopole antenna of claim 6 wherein said feeding terminal is coupled to the apex of the largest triangular Sierpinski gasket.

10. The monopole antenna of claim 6 wherein said at least two points are selected at vertices at the base of the largest triangular Sierpinski gasket.

11. The monopole antenna of claim 6 comprising two Sierpinski gaskets intersecting along said axis.

12. The monopole antenna of claim 6 further comprising another ground plane adjacent to the base of said at least one triangular Sierpinski gasket.

13. The monopole antenna of claim 6 wherein an iteration ratio of self-similarity of said fractal geometric shape is higher than 2.

14. The monopole antenna of claim 1 wherein said axis is substantially perpendicular to said ground plane.

15. The monopole antenna of claim 1 wherein a shape of said cavity is selected from a cylindrical shape, conical shape and prismatic shape.

16. The monopole antenna of claim 1 wherein said feeding line includes a coaxial probe.

17. The monopole antenna of claim 1 being configured to operate within the frequency range of about 20 MHz to 80 GHz.

18. An antenna array structure including a plurality of the monopole antenna of claim 1.

19. A method of fabricating a monopole antenna comprising:

forming a ground plane having a sheet of electrically conductive material;

forming a cavity in said sheet of electrically conductive material;

forming a radiating arm backed by the cavity and extended therefrom along an axis disposed in relation to said ground plane, at least a portion of the radiating arm having a fractal geometric shape;

coupling said radiating arm to a feeding line arranged at the cavity; and forming at least one pair of electrical shunts configured for connecting at least two points selected within the fractal portion of the radiating arm to the ground plane.

20. The method of claim 19 wherein said forming of the radiating arm includes cutting the radiating arms from a solid sheet of conductive material.

21. The method of claim 19 further comprising providing a nonconductive substrate of a predetermined form, and wherein the radiating arm is formed as a layer of electrically conductive material overlaying a surface of said nonconductive substrate.

22. The method of claim 19 wherein said forming of the two electrical shunts includes forming strips of electrically conductive material on the surface of said nonconductive substrate.

23. A method for fabricating an antenna having reduced return losses within predetermined frequency bands, the method comprising:

forming a ground plane having a sheet of electrically conductive material;

forming a cavity in said sheet of electrically conductive material;

forming a radiating arm backed by the cavity and extended therefrom along an axis disposed in relation to said ground plane, at least a portion of the radiating arm having a fractal geometric shape;

coupling said radiating arm to a feeding line arranged at the cavity; and forming at least one pair of electrical shunts configured for connecting at least two points selected within the fractal portion of the radiating arm to the ground plane.

* * * * *